US009146084B2

(12) United States Patent
Muller et al.

(10) Patent No.: US 9,146,084 B2
(45) Date of Patent: Sep. 29, 2015

(54) DETONATION OF EXPLOSIVES

(75) Inventors: Elmar Muller, Centurion (ZA); Pieter Stephanus Jacobus Halliday, Randburg (ZA); Clifford Gordon Morgan, Kempton Park (ZA); Paul Dastoor, Callaghan (AU); Warwick Belcher, Callaghan (AU); Xiaojing Zhou, Callaghan (AU); Glenn Bryant, Callaghan (AU)

(73) Assignee: AEL MINING SERVICES LIMITED, Woodmead, Sandton (ZA)

( * ) Notice: Subject to any disclaimer, the term of this patent is extended or adjusted under 35 U.S.C. 154(b) by 0 days.

(21) Appl. No.: 13/985,705

(22) PCT Filed: Feb. 20, 2012

(86) PCT No.: PCT/IB2012/050757

§ 371 (c)(1),
(2), (4) Date: Aug. 15, 2013

(87) PCT Pub. No.: WO2012/114251

PCT Pub. Date: Aug. 30, 2012

(65) Prior Publication Data

US 2013/0319276 A1 Dec. 5, 2013

(30) Foreign Application Priority Data

Feb. 21, 2011 (ZA) ..... 2011/01370
Dec. 9, 2011 (WO) ..... PCT/IB2011/055573
Dec. 9, 2011 (WO) ..... PCT/IB2011/055576

(51) Int. Cl.
*F42B 3/12* (2006.01)
*F42B 3/18* (2006.01)
(Continued)

(52) U.S. Cl.
CPC ... *F42B 3/12* (2013.01); *C06C 5/04* (2013.01); *F42B 3/113* (2013.01); *F42B 3/121* (2013.01); *F42B 3/18* (2013.01); *F42C 11/00* (2013.01); *F42C 11/008* (2013.01); *F42D 1/05* (2013.01)

(58) Field of Classification Search
CPC ..... F42B 3/10; F42B 3/113; F42B 3/12; F42B 3/121; F42B 3/13; F42B 3/18; F42D 1/04; F42D 1/043; F42D 1/045; F42D 1/05; C06C 5/00; C06C 5/04; C06C 5/06; F42C 11/00; F42C 11/008
USPC ..... 102/200, 201, 202.5, 202.7, 202.11, 102/202.14, 275.1, 275.5, 275.8, 275.11, 102/275.12
See application file for complete search history.

(56) References Cited

U.S. PATENT DOCUMENTS 3,837,282 A 9/1974 Morrow
4,020,765 A 5/1977 Glass et al.
(Continued)

FOREIGN PATENT DOCUMENTS

DE 195 46 823 6/1997
EP 0 207 749 1/1987
(Continued)

OTHER PUBLICATIONS

Written Opinion of The International Searching Authority for PCT/IB2012/050757, dated Aug. 21, 2013.*
(Continued)

*Primary Examiner* — James S Bergin
(74) *Attorney, Agent, or Firm* — Brinks Gilson & Lione; G. Peter Nichols

(57) ABSTRACT

An explosives detonator system includes a detonator housing within which is provided a detonation circuit that includes a conductive pathway having a fuse head integrated therewith such that the conductive pathway passes along both electrodes and a resistive bridge of the fuse head. An uncharged chargeable voltage source is also integrated with the detonation circuit and is electrically sensitive to a charging property which is included in a charging signal. Exposure to the charging property charges the voltage source, thereby rendering it capable of generating a potential difference between the electrodes at least to equal the breakdown voltage of the resistive bridge. The charging property is any one or more of a charging light pulse, a charging temperature, a charging pressure and a charging radio frequency.

18 Claims, 1 Drawing Sheet

(51) Int. Cl.

| | |
|---|---|
| ***F42B 3/113*** | (2006.01) |
| ***F42C 11/00*** | (2006.01) |
| ***F42D 1/05*** | (2006.01) |
| ***C06C 5/04*** | (2006.01) |

(56) References Cited

U.S. PATENT DOCUMENTS

| | | | | |
|---|---|---|---|---|
| 4,700,629 | A | 10/1987 | Benson et al. | |
| 4,869,171 | A | 9/1989 | Abouav | |
| 5,243,913 | A | 9/1993 | Brent et al. | |
| 5,435,249 | A | 7/1995 | Brent et al. | |
| 5,942,718 | A | 8/1999 | Falquete et al. | |
| 8,261,663 | B2 * | 9/2012 | Cordova et al. | 102/215 |
| 8,695,505 | B2 * | 4/2014 | Koekemoer et al. | 102/206 |
| 8,857,339 | B2 * | 10/2014 | Muller et al. | 102/206 |
| 8,967,048 | B2 * | 3/2015 | Harding et al. | 102/206 |
| 8,991,315 | B2 * | 3/2015 | Koekemoer et al. | 102/206 |
| 2005/0178282 | A1 | 8/2005 | Brooks et al. | |
| 2008/0302264 | A1 | 12/2008 | Hummel et al. | |
| 2009/0193992 | A1 | 8/2009 | Moore | |
| 2015/0013560 | A1 * | 1/2015 | Schlenter et al. | 102/202.14 |

FOREIGN PATENT DOCUMENTS

| | | |
|---|---|---|
| WO | WO 97/01076 | 1/1997 |
| WO | WO 2006/096920 | 9/2006 |
| WO | WO 2006/128257 | 12/2006 |

OTHER PUBLICATIONS

PCT/IB2011/055573 International Search Report dated Apr. 2, 2012 (2 pages).

PCT/IB2011/055573 International Preliminary Report on Patentability dated Jun. 12, 2013 (7 pages).

PCT/IB2012/050757 International Search Report dated May 8, 2012 (2 pages).

PCT/IB2011/055576 International Search Report dated May 23, 2012 (5 pages).

PCT/IB2011/055576 International Preliminary Report on Patentability dated Jun. 12, 2013 (11 pages).

U.S. Appl. No. 13/992,790, filed Jun. 10, 2013 entitled "Detonation of Explosives".

U.S. Appl. No. 13/992,794, filed Jun. 10, 2013 entitled "Detonation of Explosives".

* cited by examiner

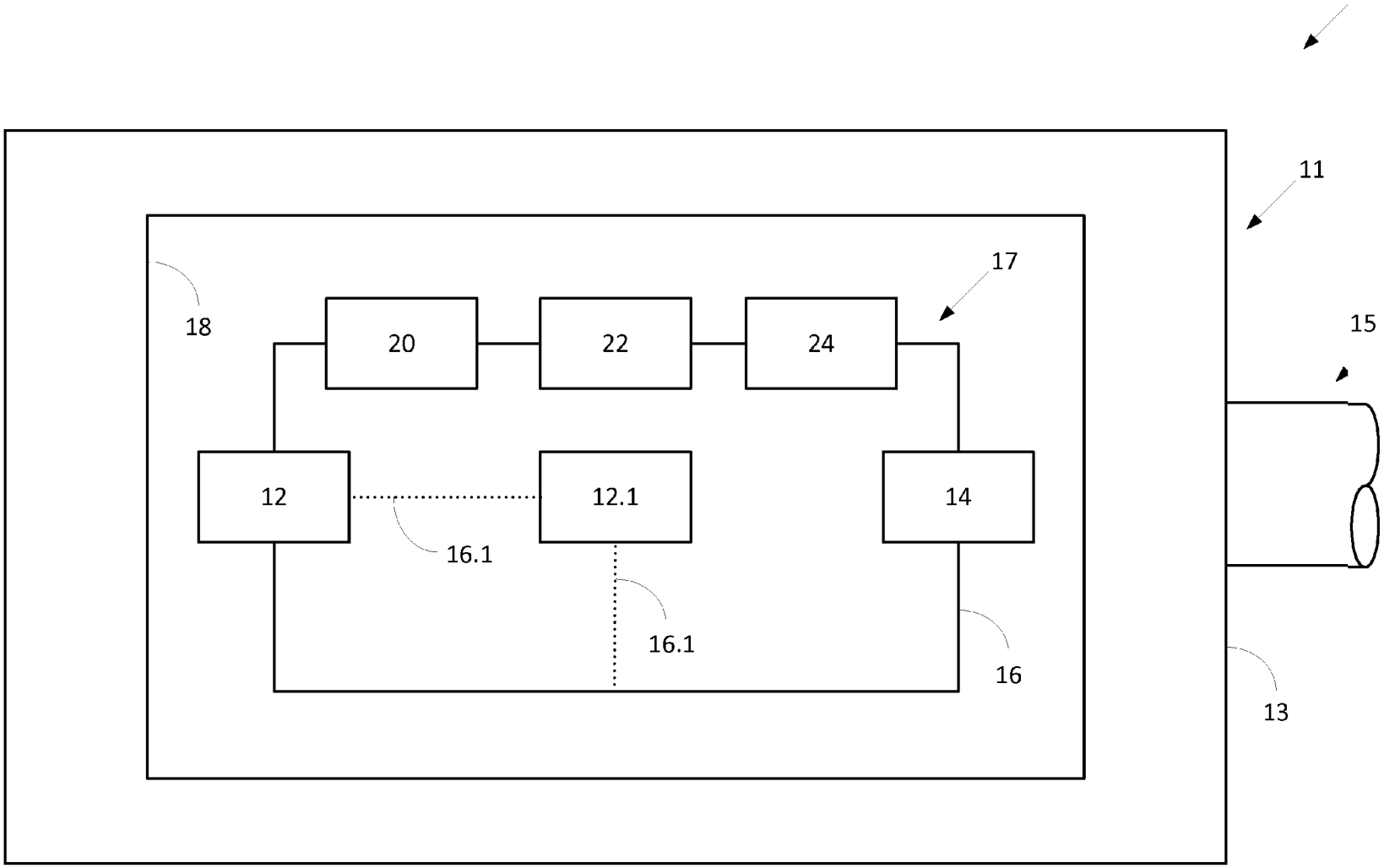
11
15
13
17
16
14
24
22
12.1
16.1
20
16.1
12
18

DETONATION OF EXPLOSIVES

This application claims priority to International Application No. PCT/IB2012/050757 filed Feb. 20, 2012; South African Application No. 2011/01370 filed Feb. 21, 2011; PCT/IB2011/055573 filed Dec. 9, 2011; and PCT/IB2011/055576 filed Dec. 9, 2011, the entire contents of each are incorporated herein by reference.

FIELD OF THE INVENTION

This invention relates to detonation of explosives. More particularly, the invention relates to detonator systems for detonating explosives with which they are arranged in a detonating relationship. The invention accordingly provides a detonator system for detonating an explosive charge with which it is, in use, arranged in a detonating relationship. The invention also provides a method of operating a detonator system.

BACKGROUND TO THE INVENTION

Detonation of explosive charges is generally effected by means of detonators which are provided in a detonating relationship with the explosive charges. Such explosive charges usually comprise so-called "main" or "secondary" explosives.

In the mining industry, in particular, as well as in a number of other industries which rely on the use of explosives, e.g. the demolition industry, accurate control of explosives detonation is of great importance, for reasons including safety and accuracy of blasting operation.

Generally speaking, one can distinguish between two types of detonators namely electronic detonators and pyrotechnic detonators.

Electronic detonators, generally, effect detonation of an explosive with which they are in a detonating relationship by generating a voltage spark or plasma in proximity to the explosive. Such voltage spark or plasma is generated by the breakdown of a resistive element or bridge which is provided between two conducting electrodes. The resistive bridge and the electrodes are generally referred to collectively as a "fuse head" which is accommodated within a detonator housing. The plasma generates a shock wave which is transmitted to the proximate explosive and initiates the explosive.

Such electronic detonators generally provide accurate control over detonation, particularly as regards timing and delay properties thereof. However, electronic detonators are expensive to manufacture and difficult to use, requiring a separate or external power source and complex electronic transmission wire connections to allow transmission of electricity to the detonator and permit remote triggering thereof. In the applicant's experience, such connections are, in the Applicant's experience, prone to failure and may even result in, or allow for, premature initiation of the detonator and thus of the explosive, due to false stimuli, e.g. being provided by radio-frequency (rf) interference on the mining/demolition site.

In contrast to electronic detonators operating by means of an electronic delay system, pyrotechnic detonators employ a series of explosive charges that are located within a detonator housing to provide a desired detonating signal to the main explosive charge at a required timing and delay. The series of explosive charges generally includes (i) an initiating and sealing charge, also known as a priming charge, (ii) a timing charge, (iii) a primary charge and, optionally, (iv) a base charge. The initiating charge serves to initiate the explosive sequence in response to a shock signal transmitted thereto and also functions as a sealing charge which provides a seal to prevent blow-back inside the detonator housing. The initiating charge also initiates the timing charge which provides a desired burning delay for detonation. The timing charge, in turn, initiates the primary charge which either directly provides a detonation initiating signal to the main explosive charge, or initiates the base charge that, in turn, will provide the desired detonation initiating signal to the main explosive charge.

As alluded to above, initiation of the initiating charge of a pyrotechnic detonator is generally effected by imparting a shock signal to the detonator, typically being provided by one or more shock tubes which are located in an initiating relationship with the detonator. The initiating charge then typically comprises a sensitive explosive, initiation of which can be effected by a shock wave of sufficient magnitude. Shock tube is well known and widely used in the initiation of detonators; it comprises a hollow plastic tube lined with a layer of initiating or core explosive, typically comprising a mixture of HMX and aluminium metal powder. Upon ignition of the initiating (core) explosive, a small explosion propagates along the tube in the form of an advancing temperature/pressure wave front, typically at a rate of approximately 7000 ft/s (about 2000 m/s). Upon reaching the detonator, the pressure/temperature wave triggers or ignites the initiating/sealing charge in the detonator, which results in the sequence of ignitions mentioned above and thus eventually causing detonation of the main explosive charge. Although shock tube is economically attractive, safe and easy to use, not being readily susceptible to false stimuli, existing pyrotechnic-based detonator systems do not at all permit the same extent of control of detonation timing and delay which is achieved by using electronic detonators, as the timing and delay features are provided by the detonator explosive charge loading, instead of by electric components.

It will therefore be appreciated that each of electronic and pyrotechnic detonator systems has particular disadvantages associated therewith, which disadvantages impact negatively on the operational reliability, safety and ease of use of such systems. More particularly, whilst electronic detonator systems are attractive from the perspective of the accuracy of control which they offer, the complex voltage transmission wire arrangements and connections which are required present a concern. As regards pyrotechnic detonator systems, whilst they offer the ability to employ shock tube and avoid the use of complex transmission wire, they present difficulties in achieving detonation delay control and accuracy.

The present invention therefore seeks, broadly, to provide an approach to operating explosive detonators which addresses and at least partly alleviates the disadvantages associated with both pyrotechnic and electronic initiation of explosive detonators.

More specifically, the present invention seeks to address the difficulties of complex electrical signal transmission wire connections which are associated with the operation of electronic detonator systems and also the difficulties of inaccurate delay timing and control associated with pyrotechnic detonator systems.

SUMMARY OF THE INVENTION

IN ACCORDANCE WITH ONE ASPECT OF THE INVENTION, there is provided an explosives detonator system for detonating an explosive charge with which it is, in use, arranged in a detonating relationship, the detonator system comprising a detonator housing;

a detonation circuit inside the detonator housing, the detonation circuit comprising a conductive pathway;

a fuse head inside the detonator housing, the fuse head comprising at least two spaced apart conductive electrodes and a resistive bridge spanning a space between the electrodes, and being integrated with the detonation circuit such that the conductive pathway passes along both electrodes and the resistive bridge; and an uncharged chargeable voltage source inside the detonator housing, the chargeable voltage source being integrated with the detonation circuit and being electrically sensitive to a charging property which is included in a charging signal that is, in use, communicated to the detonator, such that exposure to the charging property charges the voltage source, thereby rendering the voltage source capable of generating a potential difference between the electrodes at least to equal the breakdown voltage of the resistive bridge, wherein the charging property is any one or more of a charging light pulse, a charging temperature, a charging pressure and a charging radio frequency of the charging signal and the chargeable voltage source is therefore electrically sensitive to any one or more of the charging light pulse, the charging temperature, the charging pressure and the charging radio frequency.

For continuity with the specification of priority application number ZA2011/01370 in particular, it is noted that the detonator system corresponds, broadly, with the detonator described in ZA2011/01370. More particularly, the uncharged chargeable voltage source comprises, broadly, the integrated voltage source of ZA2011/01370.

In use, when the generated potential difference between the electrodes equals or exceeds the breakdown voltage of the resistive bridge, a voltage spark or plasma is generated between the electrodes. This plasma, in turn, generates a shock signal which causes, directly or indirectly, initiation and thus detonation of the explosive charge with which the detonator system is arranged in a detonating relationship.

The detonator housing may, in one embodiment of the invention, be of cylindrical form.

The detonator may also include a support or substrate on which the detonation circuit is provided. In such a case, the support or substrate will thus also be located inside the detonator housing. The substrate may typically be a flexible substrate and may comprise PET (polyethylene terephtalate), PEN (polyethylene naphthalate), PI (polyethylene imine) or coated paper.

The conductive pathway of the detonation circuit, and preferably the detonation circuit itself, preferably comprises integrated circuitry, thus being integrated with the substrate. In one embodiment of the invention, the conductive pathway may be etched in to the substrate. Preferably, however, the integrated circuitry is printed integrated circuitry, being printed onto the substrate as hereinafter described in more detail.

Additionally, at least some, but preferably all, of the components of the detonation circuit that are provided along the conductive pathway, i.e. the fuse head (comprising both the electrodes and the resistive bridge) and the voltage source, may also be printed on the substrate by suitable printing methods as hereinafter described in more detail. It is therefore preferred that these components do not comprise so-called surface mounted devices (or SMD's).

It will therefore be appreciated that, preferably, the detonation circuit, in its entirety, is a printed circuit, not having any SMD's included therein. Printing of the detonation circuit, i.e. the conductive pathway and its components, may be by means of ink jet printing, gravure, screen printing, off-set lithography, flexography, or any other suitable reel to reel method.

The resistive bridge of the fuse head may comprise a resistive element. Typically, the resistive element may be a thin-film element, a surface mounted device, or a resistive element obtained by chemical-dip a technique. When obtained by a chemical dip-technique, the resistive element may be applied to the substrate by dipping the substrate on which the electrodes are provided in a suitable chemical, i.e. oxidizer, fuel and/or explosive, dip and thereafter allowing the chemical to dry. Preferably however the resistive element is a printed thin film resistive element, typically being printed with a suitable polymeric or conductive ink, or metallization paste which is gold-, copper-, silver-, carbon-, stainless steel- or aluminium-based. The paste may also be carbon-based, with the carbon being in the form of carbon nanotubes. The energy output from the resistive bridge may be enhanced by adding a layer printed in a suitable output enhancement chemical (oxidizer, fuel and or explosive). By 'output enhancement', there is referred particularly, but not exclusively, to the shock wave that is generated by breakdown of the resistive bridge.

The electrodes of the fuse head may also be printed on the substrate, typically also by using a suitable conductive, e.g. metallic or polymeric, ink or paste as hereinbefore described.

As will be appreciated, the voltage source is not a pre-charged voltage source, such as an electrochemical cell or battery. The detonator system is therefor provided with a proviso that the voltage source is not pre-charged and thus not capable, in the absence of the charging signal, of generating the breakdown voltage across the electrodes. The voltage source, and thus the detonator system, can therefore be regarded as initially being in a passive state, until it is exposed to the charging property of the charging signal.

The detonator system may include shock tube that is provided in initiating proximity to the detonator. The charging signal may then be a shock signal which is provided by, and propagated along, the shock tube. The shock tube may typically have a hollow elongate body, inside of which is provided a shock tube explosive, detonation of which provides the shock signal. The shock tube may also contain, in addition to the shock tube explosive, a photo-luminescent chemical that provides or enhances the charging light pulse. The photo-luminescent chemical may typically be a fluorescent or phosphorescent chemical or, alternatively, may be a precursor for a photo-luminescent chemical, in which case it may be capable of transforming into a photo-luminescent chemical under explosive conditions. The photo-luminescent chemical may, in one embodiment of the invention, be inorganic and comprise a rare earth metal salt or combinations of two or more such salts. Typically, the salts may be selected from oxide salts, nitrate salts, perchlorate salts, persulphate salts and combinations thereof. Alternatively, the photo-luminescent chemical may be a precursor for such a salt or another luminescent oxide.

Being chargeable in nature, and initially in an uncharged condition, operation of the voltage source is dependent on a stimulus provided by an external power or energy source. This external energy source is, of course, the charging property of the charging signal. It is to be appreciated that such an external power or energy source is not regarded as the voltage source, as the generation of the voltage difference between the electrodes is achieved by means of the voltage source that is integrated with the detonation circuit and not by means of the external power source. The external power source itself, in the absence of the voltage source, is therefore not capable of generating the potential difference across the electrodes.

In one embodiment of the invention, the voltage source may include a photosensitive cell, such as a photovoltaic cell. Although the photovoltaic cell may be an SMD, the photovoltaic cell preferably is a printed photovoltaic cell that is printed onto the substrate. Typically, the photovoltaic cell is an organic photovoltaic (OPV) cell, such as a P3HT:PCBM organic photovoltaic cell. The organic photovoltaic cell may be printed on the substrate, typically with a phenyl-C61-butyric acid methyl ester (PCBM)-based ink and a polythiophene-, or more particularly poly(3-hexylthiophene) or (P3HT)-based ink.

In another embodiment of the invention, the voltage source may comprise a passive electronic component such as a capacitor and a charging component that is operatively associated with the capacitor along the conductive pathway of the detonation circuit, thus being capable of charging the capacitor. The charging component may be electrically sensitive to the charging property, such that exposure of the charging component to the charging property results in the charging component charging the capacitor, thereby rendering the capacitor capable of generating a potential difference between the electrodes at least equal to the breakdown voltage of the resistive bridge. The charging component may therefore be configured for delivering a charge of sufficient magnitude to the capacitor, such that discharge of the capacitor results in the generation of the breakdown voltage, unless a voltage booster is employed as hereinafter described. It is to be appreciated that, in such an embodiment, the voltage source therefore comprises both the capacitor and the charging component. The charging component may typically comprise one or more transistors that are in electrical communication with the voltage source along the conductive pathway of the detonation circuit.

In a further embodiment of the invention, the voltage source may comprise one or more transistors, thus in the absence of a passive electrical component such as a capacitor and with the transistor itself constituting the voltage source.

When the charging property comprises the charging light pulse, the transistor, whether being the charging component or the voltage source, may include a photosensitive material that is sensitive to the charging light pulse as a function of its output voltage, and with a light-activated change in the photosensitive material at the charging light pulse resulting in an increase in the transistor output voltage.

In one embodiment of the invention, the transistor may be operatively associated, i.e. form a bulk heterojunction, with an organic photovoltaic cell. For example, the transistor may be a pentacene-based organic thin film transistor having a P3HT-$PC_{61}$ BM organic photovoltaic cell operatively associated therewith. In such a case, photosensitivity is therefore imparted on the transistor by the organic photovoltaic cell In another embodiment of the invention, the transistor may comprise a multilayer organic thin film transistor, having alternating layers of Cu phthalocyanine and 3,4,9,10-perylenetetracaboxylic bis-benzimidazole.

In yet a further embodiment of the invention, the transistor may comprise a bulk heterojunction, i.e. operative association, of poly(3-octyl thiophene) and PCBM, being a derivative of $C_{60}$.

Still further, the transistor may comprise covalently bonded organic donor/receptor dyads.

When the charging property comprises the charging temperature, the transistor may include a temperature sensitive material that is sensitive to the charging temperature as a function of its output voltage, with a thermally-activated change in the temperature sensitive material at the charging temperature thus resulting in an increase in the transistor output voltage.

When the charging property comprises the charging pressure, the transistor may include a pressure sensitive material that is sensitive to the charging pressure as a function of its output voltage, with a pressure-activated change in the pressure sensitive material at the charging pressure resulting in an increase in the transistor output voltage.

As alluded to above, the transistor may, in particular, be an organic thin film transistor (OTFT). Alternatively, the transistor may be an organic field effect transistor (OFET).

The transistor may, in particular, be printed onto the substrate, thus being a printed transistor. When the transistor comprises and OTFT or OFET, it may be printed on the substrate by means of a suitable organic ink associated with the components of the OTFT or OFET.

In yet another embodiment of the invention, the voltage source may comprise an active of a passive or active radiofrequency identification device (RFID) that is sensitive, as a function of its output voltage, to the charging radio frequency. In such a case, the charging signal may be a radio signal, having the charging radio frequency, which is transmitted to the voltage source, i.e. the RFID, from a radio signal transmitter.

In use, the detonator system will initially be in a passive and non-detonable condition, with the chargeable voltage source being in the uncharged condition. The detonator system is therefore not capable of effecting detonation of an explosive charge. However, once the charging signal is transmitted to the voltage source, whether by means of a shock signal propagated along the shock tube or by means of a radio signal transmitted by a radio transmitter, the voltage source becomes charged and thus capable of generating the breakdown voltage across the electrodes. Generation of an electric detonation signal is thereby achieved through transmission of an analogue, or rather pyrotechnic-based, initiating signal (comprising the charging signal).

The detonator system may also include, as part of the detonation circuitry, an electronic delay device that delays generation of the breakdown voltage over the electrodes for a desired delay period. Electronic delay is therefore maintained, whilst the requirement for complex electric transmission wire connections is obviated by enabling the use of shock tube.

The detonator system may typically further include one or more trigger components that are sensitive to one or more of the charging properties, typically as a function of their conductance or conductivity. Such trigger components may be also be integrated with the detonation circuitry and may initially obstruct the generation of the breakdown voltage, until they are exposed to the charging property to which they are sensitive and which results in their conductance increasing. With their conductance increased, the obstruction which they provided is therefore removed and generation of the breakdown voltage is allowed. Such trigger components may typically include one or more transistors that include materials that are sensitive, as a function of their conductance, to one or more of the charging properties of the charging signal. It is envisaged that, in this manner, at least one charging property can be used to charge the voltage source and at least one other charging property can be used to trigger the detonator system for generation of the breakdown voltage.

IN ACCORDANCE WITH ANOTHER ASPECT OF THE INVENTION, there is provided, in an explosives detonator system comprising a detonator that has a detonator housing inside which is provided a detonator circuit that comprises a conductive pathway, having integrated therewith (i) a fuse head, comprising at least two spaced apart conductive electrodes and a resistive bridge spanning a space between the electrodes, and (ii) an uncharged chargeable voltage source that is electrically sensitive to a charging property comprising at least one of a charging light pulse, a charging pressure, a charging temperature and a charging radio frequency, such that exposure to the charging property charges the voltage source, thereby rendering the voltage source capable of generating a potential difference between the electrodes at least to equal the breakdown voltage of the resistive bridge, a method of operating the detonator system includes electrically charging the chargeable voltage source by transmitting a charging signal, having the charging property, to the voltage source; and generating, by means of the voltage source, a potential difference greater than the breakdown voltage of the resistive bridge between two electrodes.

The detonator system may, in particular, be a detonator system as hereinbefore described and thus in accordance with the invention.

The charging signal may be provided by shock tube that is arranged in initiating proximity to the detonator. In particular, the charging signal may comprise a shock signal of the shock tube. When the charging property is a charging radio frequency, the charging signal may be a radio signal having the charging radio frequency.

BRIEF DESCRIPTION OF THE DRAWINGS

The invention will now be described by way of illustrative example only with reference to the accompanying diagrammatic drawing, which shows, conceptually, a detonator system in accordance with the invention.

DETAILED DESCRIPTION OF THE INVENTION

Referring to the drawing, reference numeral 10 generally indicates an explosive detonator system in accordance with the invention.

The detonator system 10 comprises an electronic time delay detonator 11 and shock tube 15 which is connected to the detonator 11, more particularly to a cylindrical housing 13 of the detonator 11. The shock tube 15 is thus in initiating proximity to the detonator 11. It is to be appreciated that the shock tube 15 needs not be physically connected to the detonator 11 in all embodiments.

The detonator 11 includes a voltage source 12 and a fuse head 14 which are operatively connected along a conductive pathway 16. The conductive pathway 16, along with the voltage source 12 and the fuse head 14, provides a detonation circuit that is generally indicated by reference numeral 17.

It will be appreciated that the detonator 11 does not include any pyrotechnic compositions and that the detonator system 10 therefore comprises a combination of a pyrotechnic detonator system, being represented by the shock tube 15, and an electronic detonator system, being represented by the electronic detonator 11.

The detonator 11 includes a support or substrate 18 on which the detonator circuit is provided. The substrate 18 is thus located inside the detonator housing 13. The substrate is a flexible substrate, being of any one of PET, PEN, PI or coated paper.

The conductive pathway 16 comprises integrated circuitry, either being etched into the substrate 18 or, more preferably, being printed onto the substrate by means of ink jet, gravure, screen printing, off-set lithography, flexography and other reel to reel methods.

Similarly, at least some, but preferably all, of the components of the detonation circuit 17 provided along the conductive pathway 16, i.e. the voltage source 12 and the fuse head 14 (comprising both the electrodes and the resistive bridge), are also printed on the substrate 18. Thus, it is preferred that these components do not comprise so-called surface mounted devices (SMD's).

The fuse head 14 comprises two spaced apart conductive electrodes (not illustrated) with a resistive bridge (not illustrated) spanning a space between the electrodes. The conductive pathway 16 passes along both electrodes and the resistive bridge.

The resistive bridge comprises a resistive element, being either a thin-film element or a surface mounted device. Typically, the resistive element may be a thin-film element, a surface mounted device, or a resistive element obtained by chemical-dip a technique. When obtained by a chemical dip-technique, the resistive element may be applied to the substrate by dipping the substrate on which the electrodes are provided in a suitable chemical, i.e. oxidizer, fuel and/or explosive, dip and thereafter allowing the chemical to dry. Preferably however the resistive element is a printed thin film resistive element, being printed on the substrate 18 with a suitable polymeric or conductive ink, or metallization paste which is gold-, copper-, silver-, carbon-, stainless steel- or aluminium-based. The paste can also be carbon-based, with the carbon being in the form of carbon nanotubes. The energy output from the resistive bridge can be enhanced by adding an enhancement layer thereto, printed in a suitable chemical (oxidizer, fuel and or explosive).

The electrodes of the fuse head are also preferably printed on the substrate 18 with a suitable conductive, e.g. metallic or polymeric, ink or paste as hereinbefore described.

The shock tube 15 has a hollow elongate body, inside of which is provided a shock tube explosive, detonation of which provides a shock signal.

The voltage source 12 is an uncharged chargeable voltage source which is electrically sensitive to a charging property which is included in a charging signal that is, in use, communicated to the detonator system 10. In particular, exposure to the charging property charges the voltage source 12, thereby rendering the voltage source 12 capable of generating a potential difference between the electrodes of the fuse head 14, which potential difference is at least equal to the breakdown voltage of the resistive bridge. Generation of such a potential difference between the electrodes results in the generation of a voltage spark or plasma between the electrodes due to breakdown of the resistive bridge. This voltage spark or plasma is used then to initiate or detonate an explosive with which the detonator 10 is arranged in a detonating relationship.

In accordance with the invention, the charging property comprises any one or more of a charging light pulse, a charging pressure, a charging temperature and a charging radio frequency. The voltage source 12 is thus electrically sensitive to any one or more of the charging light pulse, the charging pressure, the charging temperature and the charging radio frequency In one embodiment of the invention, the voltage source 12 comprises a photosensitive cell, such as a photovoltaic cell. Although the photovoltaic cell may be an SMD, the photovoltaic cell preferably is a printed photovoltaic cell that is printed onto the substrate. In particular, the photovoltaic cell is an organic photovoltaic cell such as a P3HT:PCBM organic photovoltaic cell. The organic photovoltaic cell is also preferably printed on the substrate, typically with a phenyl-C61-butyric acid methyl ester (PCBM)-based ink and a polythiophene, or more particularly poly(3-hexylthiophene) or (P3HT)-based ink.

Alternatively, the voltage source 12 comprises a capacitor and a charging component 12.1 comprising a transistor that is operatively connected to the capacitor along the conductive pathway 16. The charging component 12.1, i.e. the transistor, is therefore configured for delivering a charge of sufficient magnitude to the capacitor, such that discharge of the capacitor results in the generation of the breakdown voltage, unless a voltage booster is employed as hereinafter described.

In the drawing, the charging component 12.1 is included in the conductive pathway 16 along alternative route 16.1. The charging component 12.1 is electrically sensitive to the charging property, such that exposure of the charging component 12.1 to the charging property results in the charging component 12.1 charging the capacitor, thereby rendering the capacitor capable of generating a potential difference between the electrodes. Sensitivity of the transistor, as the charging component 12.1, to the charging property is achieved in the manner hereinafter described.

In yet a further embodiment of the invention, the voltage source 12 may comprise one or more transistors, selected from organic thin film transistors and organic field effect transistors. The transistor is, in such an embodiment, therefore configured for delivering a charge of sufficient magnitude to the capacitor, such that discharge of the capacitor results in the generation of the breakdown voltage, unless a voltage booster is employed as hereinafter described.

Regardless of whether the transistor is the voltage source 12 or the charging component 12.1, when the charging property comprises the charging light pulse, the transistor, in one embodiment includes, for providing sensitivity to the charging light pulse, a photosensitive material that is sensitive to the charging light pulse as a function of its output voltage such that a light-activated change in the photosensitive material at the charging light pulse results in an increase in the transistor output voltage. More particularly, the transistor, in one embodiment, includes an organic photovoltaic cell that provides a photoconductive material constituting the photosensitive material. In such an embodiment, the transistor is operatively associated, i.e. forms a bulk heterojunction, with the organic photovoltaic cell. For example, the transistor can be a pentacene-based organic thin film transistor having a P3HT-$PC_{61}BM$ organic photovoltaic cell operatively associated, i.e. forming a bulk heterojunction, therewith. In another embodiment of the invention, the transistor comprises, for rendering it sensitive to the charging light pulse, a multilayer organic thin film transistor, having alternating layers of Cu phthalocyanine and 3,4,9,10-perylenetetracaboxylic bis-benzimidazole. In yet a further embodiment of the invention, for rendering it sensitive to the charging light pulse, the transistor comprises a bulk heterojunction, i.e. operative association, of poly(3-octyl thiophene) and PCBM, being a derivative of $C_{60}$. Still further, the transistor can possibly comprise, for rendering it sensitive to the charging light pulse, covalently bonded organic donor/receptor dyads.

When the charging property comprises the charging temperature, the transistor includes, for providing sensitivity to the charging temperature, a temperature sensitive material that is sensitive to the charging temperature as a function of its output voltage such that a thermally-activated change in the temperature sensitive material at the charging temperature results in an increase in the transistor output voltage. The temperature sensitive material is typically a polymeric ferroelectric material, preferably a polyvinylidene fluoride (PDVF). In such a case the temperature sensitive material is present in the transistor as a piezo- or pyroelectric polymer thin film capacitor that has thus been integrated with the transistor.

When the charging property comprises the charging pressure, the transistor includes, for providing sensitivity to the charging pressure, a pressure sensitive material that is sensitive to the charging pressure as a function of its output voltage and with a pressure-activated change in the pressure sensitive material at the charging pressure resulting in an increase in the transistor output voltage. The pressure sensitive material may include a pressure sensitive rubber, constituting a layer of the transistor, and/or a pressured sensitive laminate, constituting an external laminate of the transistor.

More particularly, the transistor may thus typically comprise an integration of an organic thin film transistor (OTFT) with the pressure sensitive material. The pressure sensitive material may, in particular, have a variable resistance that is a function of its mechanical deformation, thus imparting a change in conductivity to the OTFT at the switching pressure that is sufficient for the conductivity to be conducive to the generation of the detonation initiating voltage. One example of such a material is pressure sensitive rubber that contains carbon particles and a silicon rubber matrix. Another example of a device utilising pressure sensitive rubber for pressure detection is one based of space-charge limited transistors (SCLT), having P3HT as an active layer. A SCLT is a vertical transistor with a grid electrode inserted between source electrode and drain electrode to control the vertical current flow. As pressure is applied to the pressure sensitive rubber the resistance and therefore current in the source-drain circuit is systematically changed allowing the applied pressure to be monitored. Another possibility is the employment of a flexible pressure sensor, possibly through employment of transparent plastic foil as both the substrate and gate dielectric of the transistor 18.1. When the pressure sensitive material comprises a laminate, the laminate may typically be a polydimethylsiloxane (PDMS) mold with gold electrodes. It is to be noted, however, that OTFT's have an inherent sensitivity to applied pressure, for example pentacene transistors having a solution-processed polyvinylphenol gate dielectric on a glass substrate.

In accordance with the invention, the voltage source can also be an active or a passive radiofrequency identification device (RFID) that is sensitive, as a function of its output voltage, to the charging radiofrequency. In such a case, the charging signal comprises a radio signal, having the charging radio frequency.

When the charging property is one or more of the charging light pulse, the charging temperature and the charging pressure, the charging signal will be the shock signal that is provided by and propagated along the shock tube 15. For the purpose of providing the charging light pulse, the shock tube 15 can also contain a photo-luminescent chemical that provides or amplifies the charging light pulse. The photo-luminescent chemical is preferably a fluorescent and/or phosphorescent chemical or a chemical precursor to a fluorescent and/or phosphorescent chemical.

When the charging property is the charging radio frequency, the charging signal will be a radio signal that is provided by a radio transmitter and has the charging radio frequency.

The detonator 11 also optionally includes, as part of the detonation circuit 17, an electronic delay device 20 that delays generation of the breakdown voltage across the electrodes for a desired delay period. Electronic delay is therefore maintained, whilst the requirement for complex electric transmission wire connections is obviated by use of a non-electronic charging signal.

The detonator 11 further optionally includes, as part of the detonation circuit 17, one or more trigger components 22 that are sensitive to one or more of the charging properties, typically as a function of their conductance or conductivity. Such trigger components 22 are integrated with the detonation circuit 17 and initially obstruct the generation of the breakdown voltage, until they are exposed to the charging property to which they are sensitive and which results in their conductance increasing. With their conductance increased, the obstruction which the trigger components 22 provided is therefore removed and generation of the breakdown voltage is allowed. Such trigger components typically include one or more transistors that include materials that are sensitive, as a function of their conductance, to one or more of the charging properties of the charging signal. Such transistors may be transistors as hereinbefore described, thus including such electrically sensitive materials as also hereinbefore described. With such a configuration, at least one charging property can be used to charge the voltage source and at least one other charging property can be used to trigger the detonator system for generation of the breakdown voltage.

In use, detonator system 10 is arranged such that the detonator 11 is in detonating proximity to and thus in a detonating relationship with an explosive that is to be detonated thereby. Initially, the voltage source 12 is uncharged and thus not capable of generating the breakdown voltage across the electrodes of the fuse head 14. The detonator 11 is this not capable, in this condition, of detonating the explosive. This situation subsists, and the detonator 11 thus remains in a dormant condition, until the voltage source 12 is exposed to the charging property of the charging signal.

In detonating the explosive, the charging signal is transmitted to the detonator 11, whether by transmission of the radio signal from the radio transmitter or by initiating the shock tube 15. Once the charging property of the charging signal encounters the voltage source 12, with the voltage source 12 thus having been exposed to the charging property, the voltage source 12 becomes charged and thus rendered capable of generating the breakdown potential difference between the electrodes of the fuse head 14 and thus of detonating the explosive.

If no delay device 20 or detonation trigger 22 is provided, the charged voltage source will, on becoming fully charged for generation of the breakdown voltage, immediately discharge, thus causing breakdown of the resistive bridge and generation of the voltage plasma, with the explosive thereby being detonated. When the detonator 11, however, includes the delay device 20, discharge of the device will be delayed according to the specification of the device 20. Similarly, when the detonator 11 includes the detonation trigger 22, the charged voltage source 12 will discharge only when the trigger 22 allows the discharge, e.g. on receipt of a charging signal charging property that only reaches the detonator 11 after another charging property.

It is to be appreciated that it is envisaged that a voltage booster 24 may be required in order to boost the voltage that is provided by the voltage source 12 for the purpose of generating the breakdown voltage. Such a voltage booster may, in itself, be a transistor.

The applicant expects that a detonator system such as the detonator system 10 according to the present invention, i.e. a detonator incorporating therein a voltage source as opposed to a detonator which is reliant on an external voltage source, will be particularly useful in obviating the requirement for complex conducting wire connections which is usually associated with electronic detonators (as hereinbefore described).

The applicant believes in particular that the combination of a non-electronic or analogue detonation signal (being the charging signal) with an electronic detonation effect, combines the advantages of both the pyrotechnic-based detonator (safety of use provided by shock tube) and the electronic detonator (accuracy of timing and delay), as hereinbefore described, whilst obviating the difficulties associated with both.

The applicant expects that the invention will improve the safety of usage of explosive detonators in that the risk of failure will be reduced and greater accuracy of detonation and timing will be attained. The applicant therefore expects that a detonator in accordance with the invention will allow for greater accuracy and reliability of detonators used in detonating explosives and addresses the difficulties and concerns that are associated with purely pyrotechnic and purely electric detonators respectively.

The invention claimed is:

1. An explosives detonator system for detonating an explosive charge with which it is, in use, arranged in a detonating relationship, the detonator system comprising:

a detonator, which includes a detonator housing;

a detonation circuit inside the detonator housing, the detonation circuit comprising a printed conductive pathway;

a fuse head inside the detonator housing, the fuse head comprising at least two spaced apart printed conductive electrodes and a printed resistive bridge spanning a space between the electrodes, the fuse head being integrated with the detonation circuit such that the conductive pathway passes along both electrodes and the resistive bridge; and a printed chargeable voltage source inside the detonator housing, the chargeable voltage source being integrated with the detonation circuit and being electrically sensitive to a charging property including at least a charging light pulse and, optionally, a charging temperature, a charging pressure and/or a charging radio frequency, which charging property is included in a charging signal that is, in use, communicated to the detonator, with the voltage source being electrically sensitive to the charging property such that exposure to the charging property charges the voltage source, thereby rendering the voltage source capable of generating a potential difference between the electrodes at least to equal the breakdown voltage of the resistive bridge, having previously been incapable of doing so, wherein the printing is onto a substrate and is effected by at least one of ink jet printing, gravure, screen printing, off-set lithography, flexography, or a reel to reel method, and the system further including a shock tube that is provided, in use, in initiating proximity to the detonator and is capable of providing, as the charging signal, a shock signal, which is provided by, and propagated along the shock tube, the shock tube comprising a hollow elongate body, inside of which is provided a shock tube explosive, detonation of which provides the shock signal;

and a photo-luminescent chemical that provides the charging light pulse.

2. The detonator system according to claim 1, in which the photo-luminescent chemical is a fluorescent and/or phosphorescent chemical.

3. The detonator system according to claim 1, in which the voltage source comprises an organic photovoltaic cell.

4. The detonator system according to claim 3, in which the organic photovoltaic cell is a printed organic photovoltaic cell, being printed onto a substrate therefor with an organic ink, with the substrate thus being included inside the detonator housing.

5. The detonator system according to claim 1, in which the voltage source comprises a capacitor and a charging component that is operatively associated with the capacitor along the conductive pathway of the detonation circuit, with the charging component being electrically sensitive to the charging property, such that exposure to the charging property results in the charging component charging the capacitor, thereby rendering the capacitor capable of generating a potential difference between the electrodes at least to equal the breakdown voltage of the resistive bridge.

6. The detonator system according to claim 5, in which the charging component comprises one or more transistors.

7. The detonator system according to claim 6, in which the transistor is an organic thin film transistor (OTFT) or an organic field effect transistor (OFET).

8. The detonator system according to claim 6, in which the transistor includes a photosensitive material that is sensitive to the charging light pulse as a function of its output voltage and with a light-activated change in the photosensitive material at the charging light pulse resulting in an increase in the transistor output voltage.

9. The detonator system according to claim 6, in which the charging property includes the charging temperature, with the transistor including a temperature sensitive material that is sensitive to the charging temperature as a function of its output voltage and with a thermally-activated change in the temperature sensitive material at the charging temperature resulting in an increase in the transistor output voltage.

10. The detonator system according to claim 6, in which the charging property includes the charging pressure, with the transistor including a pressure sensitive material that is sensitive to the charging pressure as a function of its output voltage and with a pressure-activated change in the pressure sensitive material at the charging pressure resulting in an increase in the transistor output voltage.

11. The detonator system according to claim 1, in which the voltage source comprises one or more transistors.

12. The detonator system according to claim 11, in which the transistor includes a photosensitive material that is sensitive to the charging light pulse as a function of its output voltage and with a light-activated change in the photosensitive material at the charging light pulse resulting in an increase in the transistor output voltage.

13. The detonator system according to claim 11, in which the charging property includes the charging temperature, with the transistor including a temperature sensitive material that is sensitive to the charging temperature as a function of its output voltage and with a thermally-activated change in the temperature sensitive material at the charging temperature resulting in an increase in the transistor output voltage.

14. The detonator system according to claim 11, in which the charging property includes the charging pressure, with the transistor including a pressure sensitive material that is sensitive to the charging pressure as a function of its output voltage and with a pressure-activated change in the pressure sensitive material at the charging pressure resulting in an increase in the transistor output voltage.

15. The detonator system according to claim 11, in which the transistor is a printed transistor that is printed onto a substrate, with the substrate thus being included inside the detonator housing.

16. The detonator system according to claim 1, in which the voltage source comprises an active or a passive radio frequency identification device (RFID) that is sensitive, as a function of its output voltage, to the charging radio frequency.

17. The detonator system according to claim 16, in which the charging property includes the charging radio frequency, with the charging signal including a radio signal having the charging radio frequency.

18. A method of operating the detonator system according to claim 1 comprising:

electrically charging the voltage source by initiating the shock tube and transmitting the shock signal, as at least a part of the charging signal, having at least the charging light pulse as the charging property, to the voltage source; and generating, by means of the voltage source, a potential difference greater than the breakdown voltage of the resistive bridge between two electrodes.

* * * * *